US010737160B1

(12) United States Patent
Beyer

(10) Patent No.: US 10,737,160 B1
(45) Date of Patent: Aug. 11, 2020

(54) BASEBALL AND SOFTBALL BAT SWING TRAINING AID

(71) Applicant: Jeffrey T. Beyer, Bloomfield Hills, MI (US)

(72) Inventor: Jeffrey T. Beyer, Bloomfield Hills, MI (US)

( * ) Notice: Subject to any disclaimer, the term of this patent is extended or adjusted under 35 U.S.C. 154(b) by 0 days.

(21) Appl. No.: 16/510,668

(22) Filed: Jul. 12, 2019

Related U.S. Application Data

(60) Provisional application No. 62/696,922, filed on Jul. 12, 2018.

(51) Int. Cl.
*A63B 69/00* (2006.01)
*A63B 59/50* (2015.01)
*A63B 102/18* (2015.01)

(52) U.S. Cl.
CPC ..... *A63B 69/0002* (2013.01); *A63B 59/50* (2015.10); *A63B 2069/0008* (2013.01); *A63B 2102/182* (2015.10); *A63B 2209/00* (2013.01); *A63B 2225/09* (2013.01)

(58) Field of Classification Search
CPC ..... A63B 69/0002; A63B 2102/182; A63B 59/50; A63B 2069/0008; A63B 2209/00; A63B 225/09
USPC ..... 473/437, 422, 457, 450, 458, 464, 438, 473/446, 560–563, 519, 524–557, 256; D21/729–731, 753, 759
See application file for complete search history.

(56) References Cited

U.S. PATENT DOCUMENTS 3,521,883 A * 7/1970 Hamilton ..... A63B 59/50 473/437
4,000,893 A * 1/1977 Evans ..... A63B 69/38 473/437
5,980,397 A * 11/1999 Hart ..... A63B 59/50 473/437
6,533,685 B1 * 3/2003 Otten ..... A63B 59/60 473/437
6,739,989 B2 * 5/2004 Liberatore ..... A63B 69/0002 473/457
7,128,667 B2 * 10/2006 Nolan ..... A63B 21/06 473/457
7,540,813 B2 * 6/2009 Liberatore ..... A63B 15/00 473/457
7,588,500 B2 * 9/2009 Hoeckl ..... A63B 69/3638 473/226

(Continued)

*Primary Examiner* — Mitra Aryanpour
(74) *Attorney, Agent, or Firm* — Young Basile Hanlon & MacFarlane, P.C.

(57) ABSTRACT

A bat swing training aid includes a body having a generally cylindrical profile that includes a first portion and a second portion, the body being selectively attachable to a barrel of a bat and having a selectively adjustable weight value. A clamping member is disposed between the first portion and the second portion, the clamping member having an unclamped position and having a clamping position where the body is in contact with the barrel of the bat. An inner surface defines an inner diameter that is selectively adjustable in response to the clamping member being in the clamping position. One or more weight retainers are disposed around a portion of the inner surface corresponding to the first portion. Each of the one or more weight retainers is arranged to receive a weight element having a defined weight value.

20 Claims, 9 Drawing Sheets

(56) References Cited

U.S. PATENT DOCUMENTS

| | | | | |
|---|---|---|---|---|
| 7,699,723 | B2 * | 4/2010 | Herman | A63B 69/00 473/437 |
| 8,231,484 | B1 * | 7/2012 | Quinn | A63B 69/0002 473/422 |
| 8,944,943 | B2 * | 2/2015 | Heiberg | A63B 60/28 473/568 |
| 10,500,462 | B2 * | 12/2019 | Francis | A63B 60/02 473/437 |
| 2003/0130070 | A1 * | 7/2003 | Nolan | A63B 21/0605 473/437 |
| 2004/0209711 | A1 * | 10/2004 | Liberatore | A63B 15/00 473/457 |
| 2009/0069126 | A1 * | 3/2009 | Merchant | A63B 21/0605 473/437 |
| 2010/0137078 | A1 * | 6/2010 | Liberatore | A63B 15/00 473/437 |

* cited by examiner

BASEBALL AND SOFTBALL BAT SWING TRAINING AID

CROSS-REFERENCE TO RELATED APPLICATION

This application claims priority to U.S. Patent Application Ser. No. 62/696,922, filed Jul. 12, 2018, the content of which is incorporated herein in its entirety by reference.

TECHNICAL FIELD

This disclosure relates to a training aid for bat swings, particularly for baseball and softball bats.

BACKGROUND

In the game of baseball and/or softball, bat swing speed plays an important role in the likelihood of the batter's success. For example, when a batter swings a bat at a ball, such as a baseball or a softball, a faster bat speed will result in a harder hit ball. Harder hit balls are more likely to result in successful outcomes, such as, a single, double, triple, or homerun. Typically, a batter may improve swing speed by utilizing specialized training bats. A batter may select a training bat that is of an appropriate weight for the batter's current size, age, and/or batting skills. The weight of such training bats is not adjustable. Accordingly, as a batter advances in batting skills, grows, and/or ages, the bat selected by the batter may be ineffective for training and the batter may have to select a different training bat having a suitable weight corresponding to the batter's current batting skills, size, and/or age.

BRIEF SUMMARY

A bat swing training aid described herein comprises a body having a generally cylindrical profile that includes a first portion and a second portion, the body being selectively attachable to a barrel of a bat and having a selectively adjustable weight value, a clamping member disposed between the first portion and the second portion, the clamping member having an unclamped position and having a clamping position where the body is in contact with the barrel of the bat, an inner surface defining an inner diameter that is selectively adjustable in response to the clamping member being in the clamping position, and one or more weight retainers disposed around a portion of the inner surface corresponding to the first portion, each of the one or more weight retainers arranged to receive a weight element having a defined weight value.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
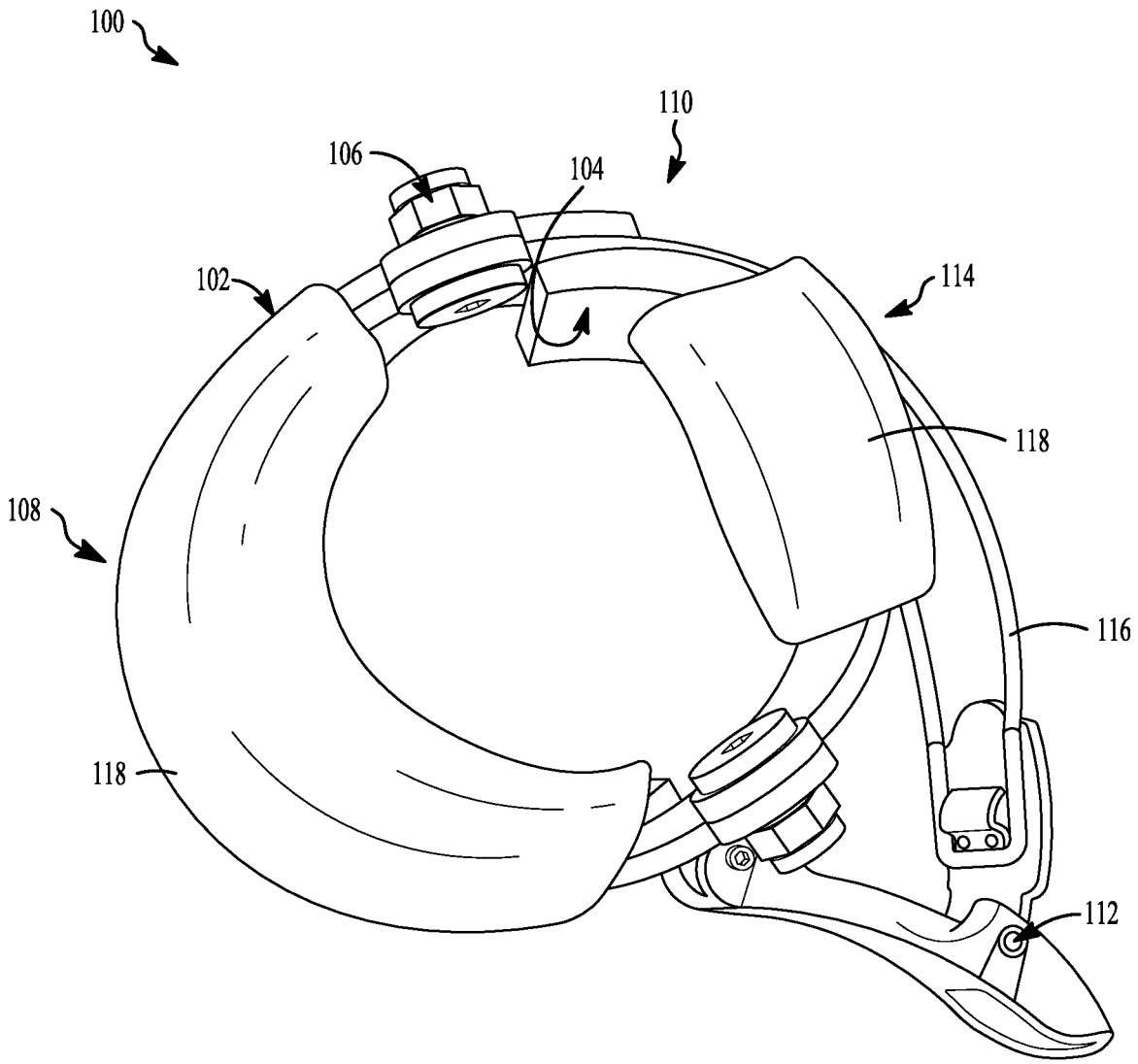
FIG. 1 illustrates a bat swing training aid according to principles of the present disclosure.

As described above, a batter's bat speed plays an important role in the likelihood of the batter's success. When a batter swings at a ball, such as a baseball or a softball, the ability for the batter to swing faster will allow the batter to hit the ball harder. Hitting a ball with a higher bat speed may result in the ball leaving the bat with a higher exit velocity. Higher exit velocities may result in more desired hitting outcomes, such as hitting a single, a double, a triple, or a homerun.

Typically, a batter improves bat speed and/or other aspects of the batter's swing by utilizing specialized training bats, as described above. For example, a batter may use a first bat, which may include a baseball bat or a softball bat, having a first length value and a first weight value for use during normal play. The first length value and the first weight value may correspond to a length and weight that are appropriate for the batter's size, age, and/or batting skill. For example, a youth batter may use a bat having a relatively small length value and a relatively small weight value while an adult batter may use a bat having a relatively large length value and a relatively large weight value. In the baseball and softball industry, the length to weight ratio of a bat is commonly referred to as the bat's drop. A drop 10 bat may have a difference of 10 between the length and the weight. For example, a bat may be 28 inches long and weigh 18 ounces, resulting in a drop 10 rating.

In order to improve bat speed and/or other aspects of the batter's swing, a batter may select a first training bat having the same or similar length value as the first bat (e.g., the first length value) and a weight value that is larger than the first weight value. For example, a batter may select a first training bat having a weight value that is 10% larger than the first weight value, 20% larger than the first weight value, or other suitable weight value. The batter may then alternate practice swings between the first bat and the first training bat. Using the first training bat may improve the batter's strength, swing acceleration, bat speed, shape of the batter's swing, other characteristics of the batter's swing, or a combination thereof.

As a batter advances in batting skills, grows, and/or ages, the batter may use a bat, referred to as a second bat, such as a baseball bat or a softball bat, during normal play that has a second length value that is larger than the first length value of the first bat and a second weight value that is larger than the first weight value of the first bat. For example, a typical training bat may include a static amount of mass embedded in the barrel or end of the training bat that causes the training bat to weigh more than a typical bat used by the batter during normal play. Because the mass is static, the weight value of the training bat is not adjustable. Accordingly, the batter may have to select a second training bat having the same or similar length value as the second bat (e.g., the second length value) and a weight value that is larger than the second weight value. The batter may continue to select subsequent training bats as the batter continues to advance in batter skills, grows, and/or ages. This can be costly and inconvenient. Accordingly, a bat swing training aid that has an adjustable weight and/or that is selectively removable from a bat used by the batter during normal play may be desirable.

FIG. 1 illustrates a bat swing training aid 100 according to principles of the present disclosure. As will be described in detail, the training aid 100 includes a selectively adjustable weight value, such that the weight value of the training aid 100 may be adjusted to accommodate changes in the batter's batting skills, size, and/or age. As will be described, the training aid 100 includes an inner diameter that is selectively adjustable, such that the training aid 100 can be adjusted to fit a variety of bats. Additionally, or alternatively, the training aid 100 is selectively attachable to and/or removable from a bat. In some embodiments, the training aid 100 comprises a polymer material or other suitable material. For example, the training aid 100 may comprise a rubberized polymer material that includes anti-slip characteristics, such that a surface area of the training aid 100 facing a portion of the bat limits and/or prevents slipping between the training aid 100 and the bat.

As shown, the training aid 100 includes an outer surface 102 and an inner surface 104. The training aid 100 is adapted to be attached or coupled to a barrel of a bat, such as a baseball bat or a softball bat. A bat includes a handle and a barrel. The handle may include a diameter that is smaller than a diameter of the barrel. The barrel is disposed on the bat opposite the handle. The barrel includes a portion of the bat that contacts a ball, such as a baseball and/or softball, when in use.

As described above, the training aid 100 includes a weight value. The training aid 100, when attached or coupled to the barrel of the bat, increases a weight value of the bat by the weight value of the training aid 100. The training aid 100 is designed (e.g., sized, dimensioned, etc.) to be attached or coupled to a portion of the barrel of the bat that is proximate the end of the bat such that, when the batter swings the bat while the training aid 100 is attached or coupled to the barrel of the bat, the batter feels the barrel end of the bat (e.g., due to the additional weight of the training aid 100 disposed at the end of the bat). The training aid 100 desirably does not interfere with the bat contacting the ball (e.g., when the batter swings the bat at the ball) when the training aid 100 is attached or coupled to the end of the barrel of the bat.

The training aid 100 may be selectively adjustable in order to accommodate various barrel sizes corresponding to various bats. For example, the training aid 100 may include at least one hinge 106. In some embodiments, the hinge 106 is disposed between a first portion 108 of the training aid 100 and a second portion 110 of the training aid 100. In some embodiments, the first portion 108 and/or the second portion 110 may be selectively rotatable about the hinge 106. For example, the second portion 110 may be positionable between a first position and a second position. The second portion 110 may be positionable in any suitable position between the first position and the second position.

The inner surface 104 defines an inner diameter of the training aid 100. The inner diameter of the inner surface 104 may correspond to an outer diameter of a barrel of a bat. When the training aid 100 is attached or coupled to the barrel of a bat, the inner surface 104 is in contact with a surface of the barrel of the bat. The inner surface 104 may include a material that prevents damage to the surface area of the barrel of the bat such as the polymer material mentioned previously, or another lining material affixed in whole or in part on the inner surface 104.

The inner diameter may be selectively adjusted between a first inner diameter and a second inner diameter in response to the second portion 110 being adjusted between the first position and the second position. The first inner diameter is different from the second inner diameter, and may be smaller than the second inner diameter. The first inner diameter may correspond to a minimum inner diameter of the inner surface 104 and the second inner diameter may correspond to a maximum inner diameter of the inner surface 104. These diameters may correspond to outer diameters of bats with which the training aid 100 may be used. For example, first inner diameter may correspond to a barrel of a bat having a diameter of 2.25 inches and the second inner diameter may correspond to a barrel of a bat having a diameter of 2.75 inches. While certain examples are described herein, it is understood the training aid 100 may be sized to accommodate other suitable barrels having different diameters.

The training aid 100 includes a clamping member 112 disposed on the outer surface 102. The clamping member 112 may include an over center clamping member as shown by example in FIG. 1, or another suitable clamping member. The clamping member 112 is designed to adjust the inner diameter defined by the inner surface 104 so as to secure the training aid 100 to the barrel of the bat. For example, the training aid 100 may be adjusted to accommodate the barrel of the bat, as described. The training aid 100 is slid onto the barrel of the bat, as its initial inner diameter is desirably larger than the barrel. The clamping member 112 may then be moved into a clamping position. When the clamping member 112 is in the clamping position, the second portion 110 is drawn toward the first portion 108, such that the inner surface 104 contacts the barrel of the bat. The training aid 100 fits snug around the barrel of the bat, which may prevent the training aid 100 from sliding off the barrel of the bat when the bat is swung by the batter.

Figure 2:
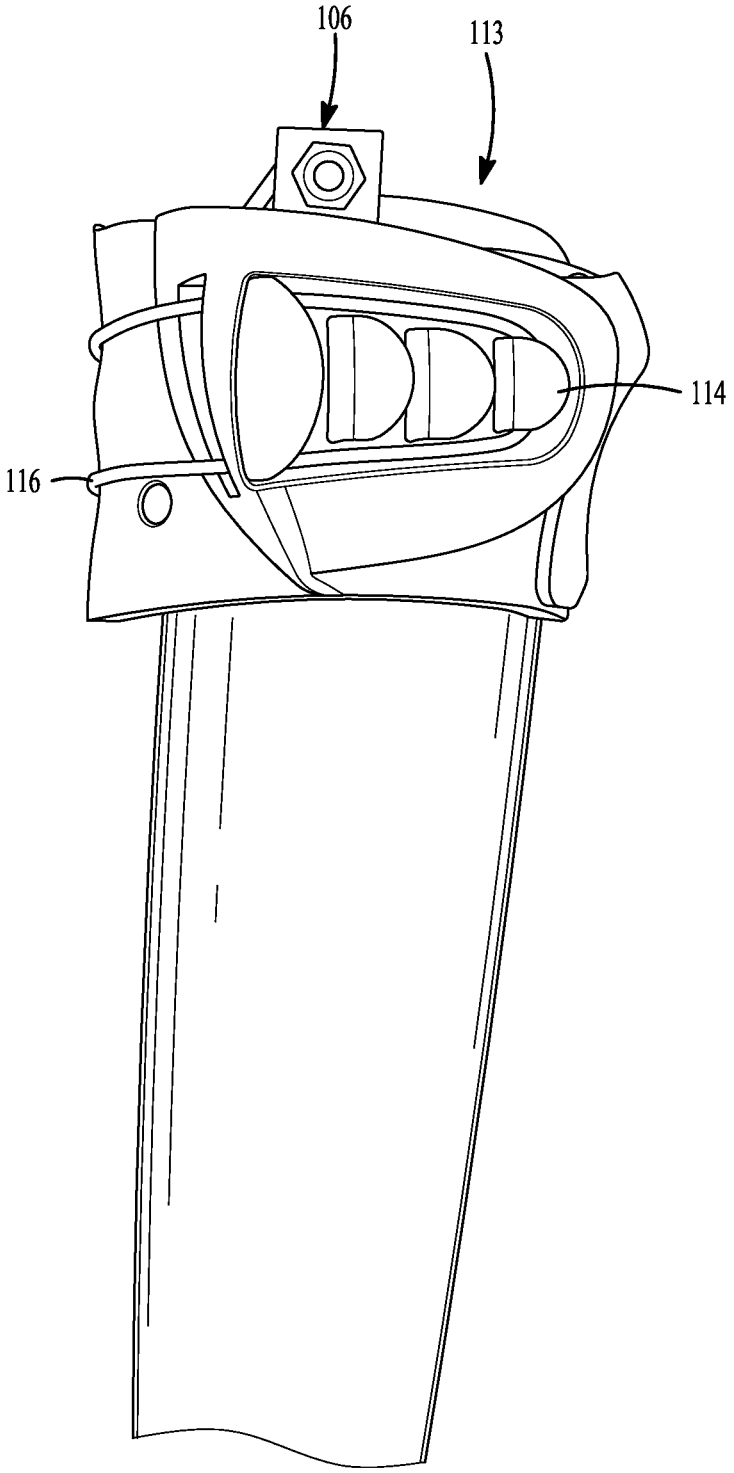
FIG. 2 illustrates a side view of the bat swing training aid of FIG. 1.
Figure 3:
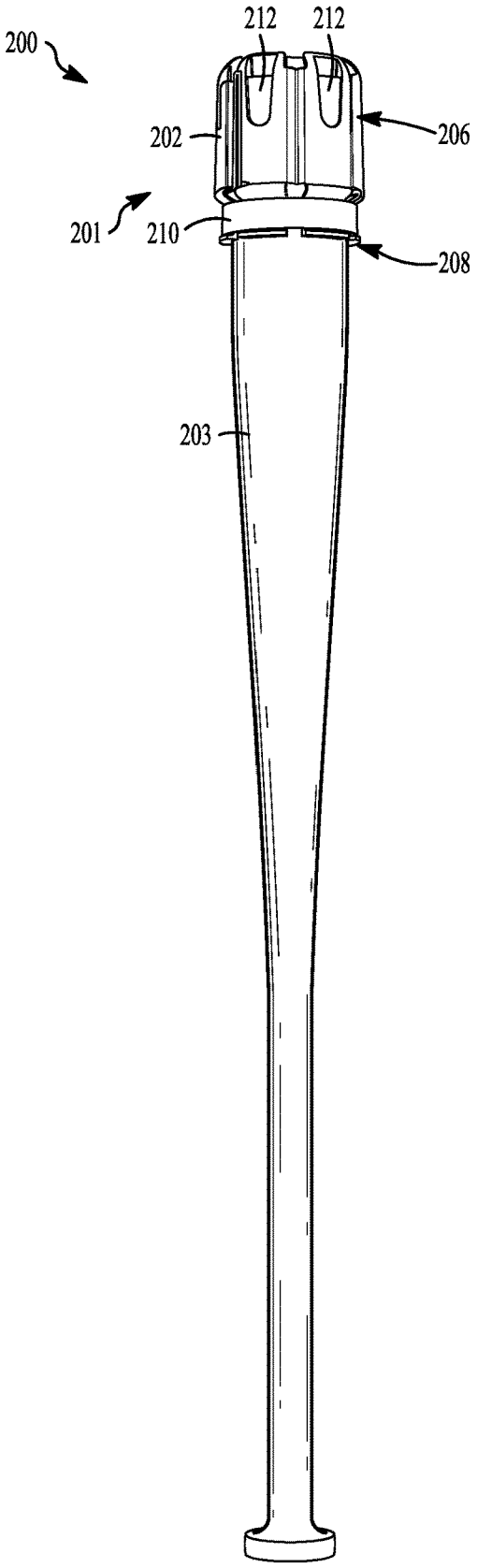
FIG. 3 illustrates an alternative bat swing training aid according to principles of the present disclosure.
Figure 4:
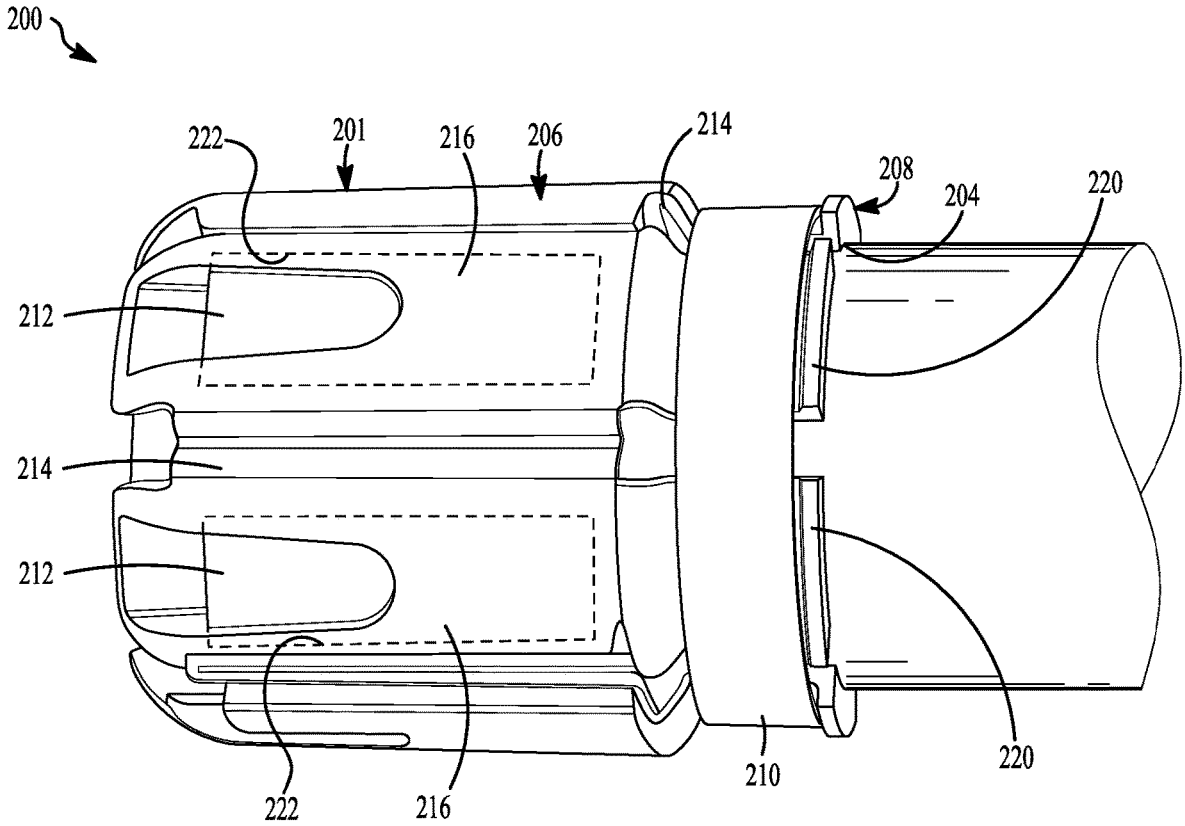
FIG. 4 illustrates a side view of the alternative bat swing training aid of FIG. 3.

As is illustrated in FIG. 2, the training aid 100 may include a ratcheting mechanism 113 that includes one or more ratcheting members 114 and a retaining member 116. The ratcheting mechanism 113 is located about a portion of the body, and allows adjustment of the inner diameter for a tight engagement of the training aid with the barrel. When used as part of the clamping member 112, the ratcheting mechanism 113 allows for further selective adjustment of the inner diameter when the clamping member 112 is in the clamping position. The ratcheting members 114 are adapted to engage a portion of the retaining member 116. For example, a portion of the retaining member 116 may include a looped portion. The looped portion is adapted to engage the ratcheting members 114, such that the looped portion loops around a respective ratcheting member 114 when the clamping member 112 is in the clamping position. For example, when the second portion 110 is in the second position (e.g., the training aid 100 is fit around a relatively large barrel), the looped portion of the retaining member 116 may engage a ratcheting member 114 that is disposed proximate to the clamping member 112. Conversely, when the second portion 110 is in the first position (e.g., the training aid 100 is fit around a relatively small barrel), the looped portion of the retaining member 116 may engage a ratcheting member 114 that is disposed away from the clamping member 112. The looped portion of the retaining member 116 is adapted to engage other suitable ratcheting members 114 when the second portion 110 is in a position between the first position and the second position.

In some embodiments, the weight value of the training aid 100 is selectively adjustable between a first weight value and one of a plurality of weight values. For example, the first weight value may correspond to a base weight value of the training aid 100 (i.e., the body and optionally the clamping member 112 without any additional weights). The first weight value may be 2 ounces, or another suitable base weight value. Additional weight may be added to the training aid 100. For example, the training aid 100 includes one or more weight retainers 118. The weight retainers 118 may include pockets, sleeves, or other suitable weight retainers. The weight retainers 118 are adapted or configured to receive one or more weight elements, and to secure them such that the weight elements do not displace during a swing. In some embodiments, the weight elements are formed of steel or another suitable material. The weight element may have a predetermined weight value. For example, a weight element may have a weight value of 1 ounce. Accordingly, the weight value of the training aid 100 may be increased in increments of weight corresponding to the weight value of the weight elements used with the training aid 100. Each weight element may have the same or a different weight value. The training aid 100 may be increased from the first weight value to a maximum weight value. For example, the weight value may be 1 ounce for each weight element, such that the training aid 100 may increasing in weight in 1-ounce increments until reaching the maximum weight value. The maximum weight value may be between 7 ounces and 8 ounces, inclusive, or another suitable maximum weight value. The training aid 100 may be adjusted to any suitable weight value between the first weight value and the maximum weight value. In this manner, the weight value of the training aid 100 is adjustable to accommodate changes in the batter's batting skills, size, and/or age, without replacing the training aid 100. The base or first weight value may be referred to as a minimum weight value.

FIGS. 3-6 illustrate an alternative bat swing training aid 200 according to principles of the present disclosure. The training aid 200 includes a selectively adjustable weight value, such that the weight value of the training aid 200 may be adjusted to accommodate changes in the batter's batting skills, size, and/or age. As will be described, the training aid 200 includes an inner diameter that is selectively adjustable, such that the training aid 200 can be adjusted to fit a variety of barrels corresponding to various bats, such as various baseball bats and/or softball bats. Additionally, or alternatively, the training aid 200 is selectively attachable to and/or removable from a bat. The training aid 200 comprises a polymer material or another suitable material. For example, the training aid 200 may comprise a rubberized polymer material that includes anti-slip characteristics, such that a surface area of the training aid 200 facing a portion of the bat limits and/or prevents slipping between the surface area of the training aid 200 and the bat.

The training aid 200 includes a body 201 having an outer surface 202 and an inner surface 204. The training aid 200 is sized and configured to be attached or coupled to a barrel of a bat, for example, a bat 203. The bat 203 in this example has a 2.25-inch diameter. As described above, the training aid 200 includes a weight value. The training aid 200, when attached or coupled to the barrel of the bat, increases a weight value of the bat by the weight value of the training aid 200. Like the training aid 100, the training aid 200 is for attachment or coupling to a portion of the barrel of the bat that is proximate the end of the bat. In this way, when the batter swings the bat while the training aid 200 is attached or coupled to the barrel of the bat, the batter feels the end of the bat (e.g., due to the additional weight of the training aid 200 disposed at the end of the bat). Desirably, the training aid 200 does not interfere with the bat contacting the ball (e.g., when the batter swings the bat at the ball) when the training aid 200 is attached or coupled to the end of the barrel of the bat.

The body 201 has a generally cylindrical profile and is adapted to slide over the end of the barrel of a bat. That is, it has an initial diameter of the of the inner surface 204 in an unclamped station such that the training aid 200 is able to fit over the end of the largest barrel size with which the training aid 200 is to be used. The body 201 may include an accordion like profile that allows one or more portions of the body 201 to adjust when clamped, as will be described. The body 201 is selectively adjustable to accommodate various barrel sizes corresponding to various bats, such as various baseball bats and/or softball bats. To achieve this goal, the body 201 of the training aid 200 includes a first portion 206 and a second portion 208. The first portion 206 is disposed on the body 201 opposite the second portion 208. The training aid 200 includes a clamping member 210 disposed on the body 201 between the first portion 206 and the second portion 208.

The clamping member 210 may include an over center clamping member or other suitable clamping member. The clamping member 210 is adapted to secure the training aid 200 to the barrel of the bat. For example, the training aid 200 may be slide over the end of the barrel of the bat. The clamping member 210 may be adjusted to a clamping position, as described above. When the clamping member 210 is in the clamping position, the inner surface 204 of the training aid 200 is drawn in toward the surface area of the barrel of the bat, such that the training aid 200 fits snug around the end of the barrel of the bat. The clamping member 210 extends circumferentially about the outer surface 202 of the body 201.

The inner surface 204 defines an inner diameter of the training aid 200. The inner diameter of the training aid 200 may correspond to an outer diameter of a barrel of a bat. When the training aid 200 is attached or coupled to the barrel of a bat, the inner surface 204 is in contact with a corresponding surface area of the barrel of the bat. The inner surface 204, in whole or in part, may include a material that is adapted to prevent damage to the surface area of the barrel of the bat, such as the materials described with regards to the training aid 100.

In some embodiments, the clamping member 210 includes a ratcheting mechanism (not shown in FIGS. 3-6). The ratcheting mechanism may include features similar to those of the ratcheting mechanism 113 of the training aid 100. The clamping member 210 may instead comprise a different clamping mechanism, such as that described below with regards to FIGS. 7-9. The clamping member 210 is adjustable between a plurality of diameters, such as the first and second diameters discussed above that may be used with bats of different diameters. For example, when the clamping member 210 is adjusted to the first diameter, the inner surface 204 is drawn toward the surface area of the barrel of a (e.g., smaller diameter) bat, which adjusts the inner diameter defined by the inner surface 204. When the inner diameter defined by the inner surface 204 is adjusted in accordance with the first diameter of the clamping member, the training aid 200 fits snug around a barrel of a bat having an outer diameter corresponding to the inner diameter, which is arranged to prevent the training aid 200 from sliding off of the barrel when the batter swings the bat 203.

When the clamping member 210 is adjusted to the second diameter, the inner surface 204 is drawn toward the surface area of the barrel of a (e.g., larger diameter) bat, which adjusts the inner diameter defined by the inner surface 204. When the inner diameter defined by the inner surface 204 is adjusted in accordance with the second diameter of the clamping member 210, the training aid 200 fits snug around a barrel of a bat having an outer diameter corresponding to the inner diameter, which is arranged to prevent the training aid 200 from sliding off of the barrel when the batter swings the bat. While only certain examples are described, the clamping member 210 may achieve any suitable diameter corresponding to the clamping member 210 engaging securing the inner diameter to the outer diameter of a bat.

As described above, first diameter may correspond to a barrel having a diameter of 2.25 inches and the second diameter may correspond to a barrel having a diameter of 2.75 inches. While certain examples are described, it is understood the training aid 200 may accommodate other diameter barrels.

Figure 5:
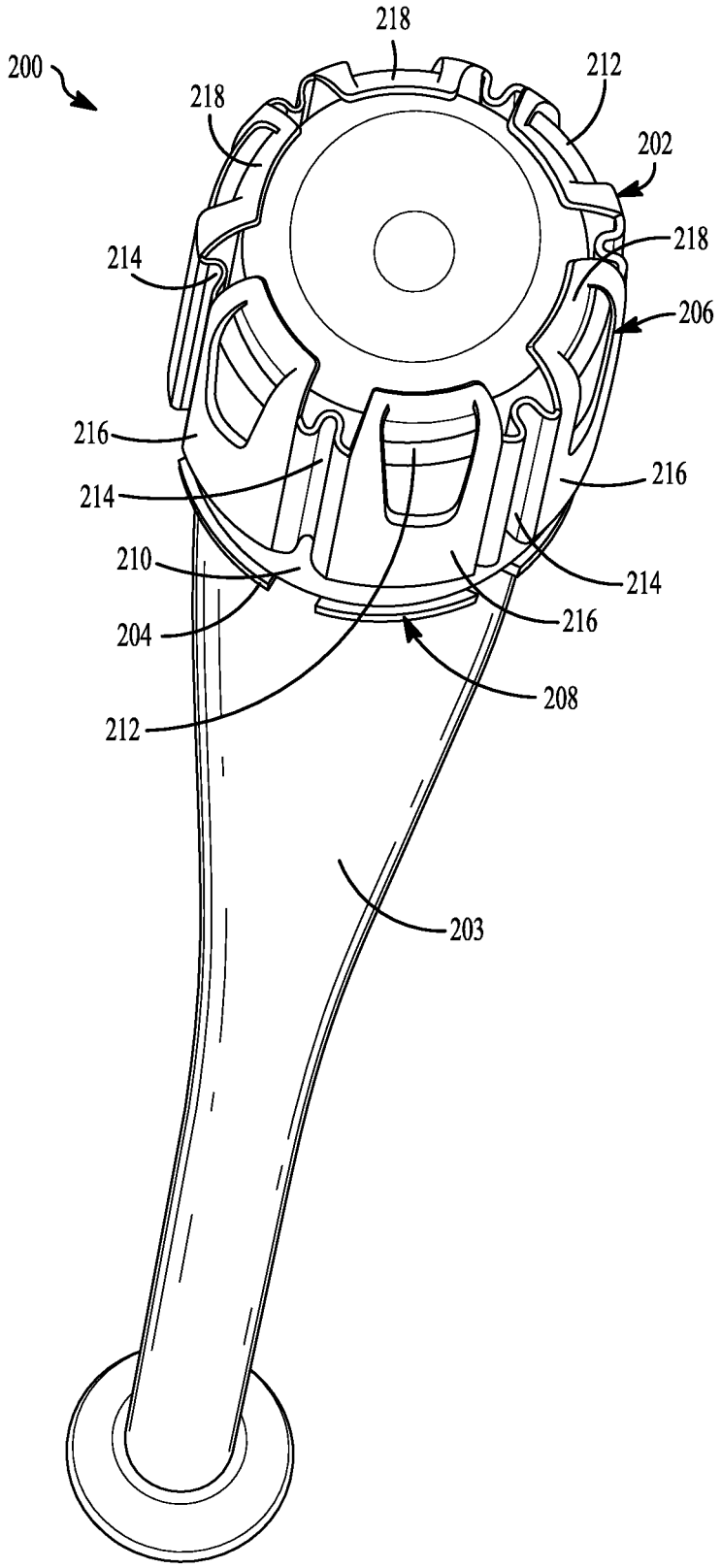
FIG. 5 illustrates a perspective view of the alternative bat swing training aid of FIG. 3.
Figure 6:
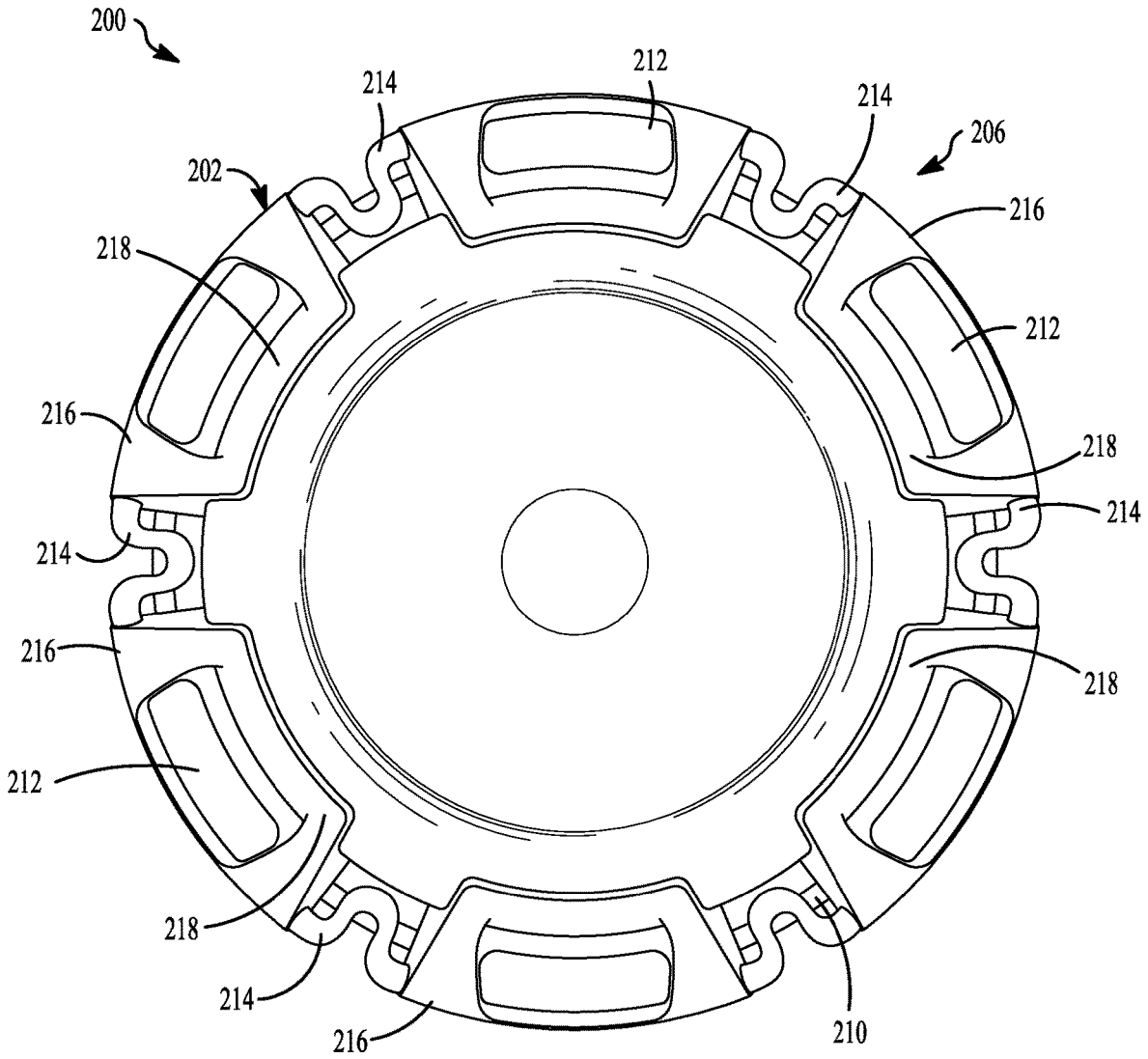
FIG. 6 illustrates a top view of the alternative bat swing training aid of FIG. 3.

As mentioned briefly above, the body 201 of the training aid 200 may have a generally cylindrical profile that is initially sized to fit loosely over the end of the barrel of a bat. The body 201 has an accordion-like profile. In this example, the first portion 206 includes living accordion type hinges 214 between hinge pockets 216. In this example, and as best seen in FIGS. 5 and 6, there are six hinge pockets 216, each able to hold a weight (also called a weight element) 212. The generally cylindrical body 201 is formed so that the hinge pockets 216 of the first portion 206 have respective extensions, teeth, or flanges 218 that extend radially inward from an end opposite the second portion 208. Accordingly, when the body 201 is fitted over a bat, the extensions 218 extend towards the axis of the bat, bat 203 in this example. In some implementations, the extensions 218 may loosely contact the top or hitting end of the bat. Desirably, when the clamping member 210 is tightened so that the inner diameter is secured to the outer diameter of the bat, the extensions 218 are secured in contact with at least a portion of the surface of the bat as shown in FIGS. 5 and 6.

The hinge pockets 216 of the first portion 206 may extend to the second portion 208. The second portion 208 may comprise one or more flanges against which to secure the clamping member 210. In this example, the second portion 208 comprises a plurality of hinged clamp flanges 220 that extend up toward the first portion 206 when the clamping member 210 is in an unclamped position (that is, for example, loosely attached to the body 201 without securing the body 201 to the bat), or when the clamping member 210 is completely unattached from the body 201. The plurality of hinged clamp flanges 220 that extend down toward the bat 203 in order for the clamping member 210 to be secured in the clamping position As with the training aid 100, the weight value of the training aid 200 is selectively adjustable between a first weight value and one of a plurality of weight values. For example, the first weight value corresponds to a base weight value of the training aid 200 (i.e., without any added weights). The first weight value may be 2 ounces, or another suitable base weight value. Additional weight may be added to the training aid 200. For example, the training aid 200 includes a respective weight element 212 in one or more weight retainers 222. The weight retainers 222 may include pockets, sleeves, or other suitable weight retainers. The weight retainers 222 may be disposed circumferentially around the inner diameter of a portion of the inner surface 204 corresponding to the first portion 206. The weight retainers 222 are adapted to receive and/or retain one or more weights or weight elements. For example, a weight retainer 222 may include an inner portion having a profile corresponding to an outer profile of a weight element 212, as shown by the dashed lines in FIG. 4.

The weight retainer 222 may include one or more retaining members adapted to retain a weight element. For example, the retaining members may include springs, clamps, adhesives, pockets, or other suitable retaining members. In the example of FIGS. 3-6, the weight elements 212 are press fit into respective weight retainers 222 when the plurality of hinged clamp flanges 220 extend up toward the first portion 206 into an open position. Thereafter, the plurality of hinged clamp flanges 220 are lowered towards the bat, and the clamping member 210 is ratcheted, screwed, crimped, or otherwise moved from the unclamped position to the clamping position about the body 201 between the first portion 206 and the second portion 208, and specifically between the hinge pockets 216 and the outer flanged perimeter of the plurality of hinged clamp flanges 220. The outer flanged perimeter may be formed by an outermost radially extending flange edge of the hinged clamp flanges 220.

The top edge of the weight element 212 is wider than an opening of the hinge pocket 216 along the outer peripheral surface of a hinge pocket 216. As a result, the weight element 212 is secured during a batter's swing. The weight elements 212 may be removed by pushing along the top edge of the weight element 212 that extends to the opening when the clamping member 210 is once again moved to the unclamped position so that the hinged clamp flanges 220 may be raised up from their closed or secured position to the open position that provides access to the weight retainers 222 within the hinge pockets 216.

As mentioned previously, the weight elements may be formed of steel or another suitable material. In this example, the weight or weight elements 212 may be molded from a polymer with a metal filler. The polymer may be a high-specific gravity polymer. The weight may have a predetermined weight value. For example, a weight may have a weight value of 1 ounce or another suitable weight. Accordingly, the weight value of the training aid 200 may be increased in increments of weight corresponding to the weight value of the weight element. The weight element may be rectilinear in shape, or may have another shape. The weight element may have smooth edges. The weight element may be contoured for a tight fit with the bat. As can be seen in FIGS. 5 and 6, for example, the weight elements 212 are contoured generally to conform to the curve of the outer surface of the bat 203.

The training aid 200 may be increased from the first or minimum weight value to a maximum weight value, such as described previously. In this example, each of the hinge pockets 216 has a respective weight element 212 within a respective weight retainer 222. Accordingly, for a 2-ounce body 201, and weight elements 212 each having a weight value of 1 ounce, the training aid 200 has a maximum weight value of 8 ounces. The training aid 200 may have a weight value of 2 ounces, 3 ounces, 4 ounces, 5 ounces, 6 ounces, 7 ounces, or 8 ounces in this example, depending upon the number of weight elements 212 supported by the body 201.

Figure 7:
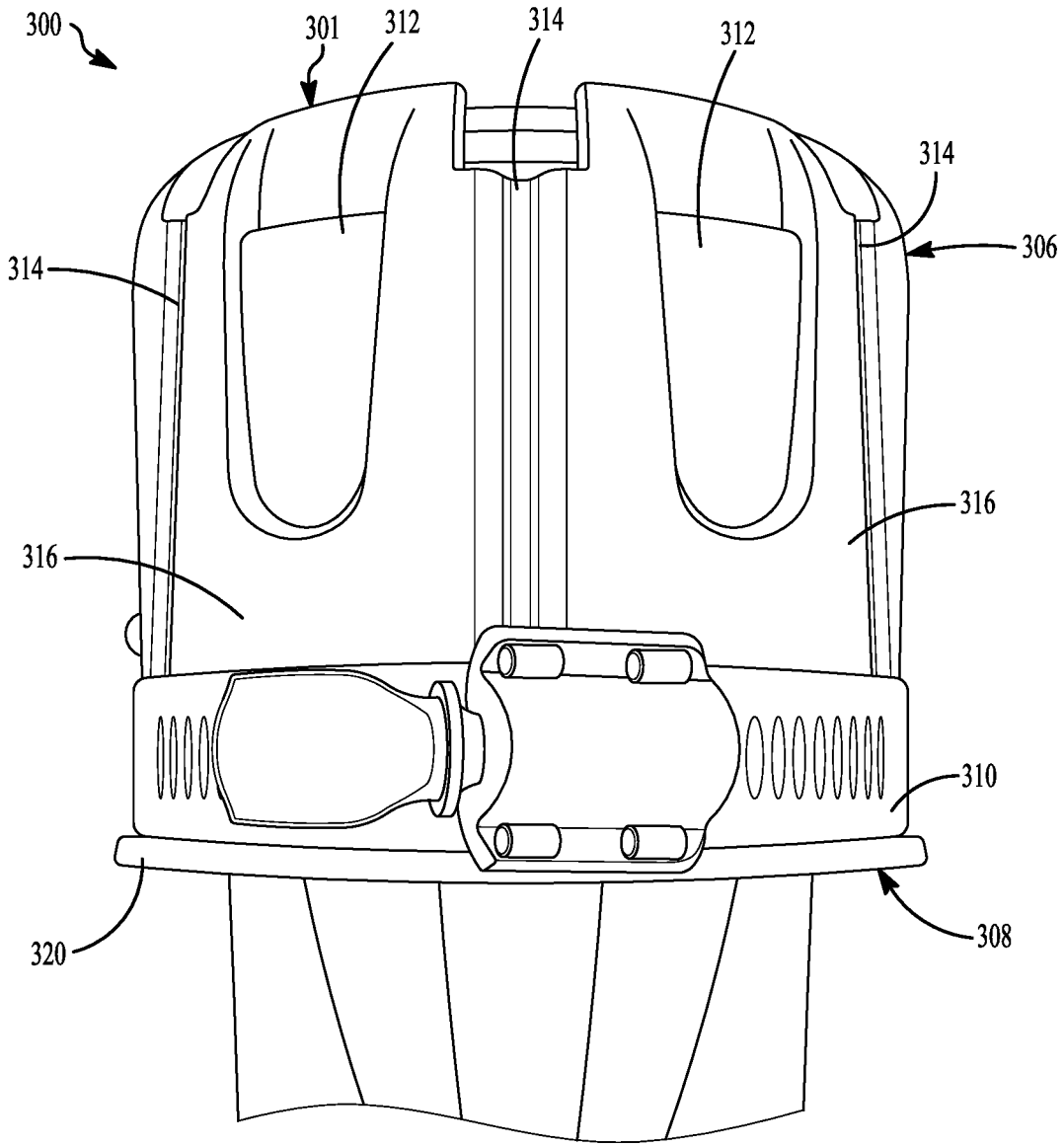
FIG. 7 illustrates an alternative bat swing training aid according to principles of the present disclosure.
Figure 8:
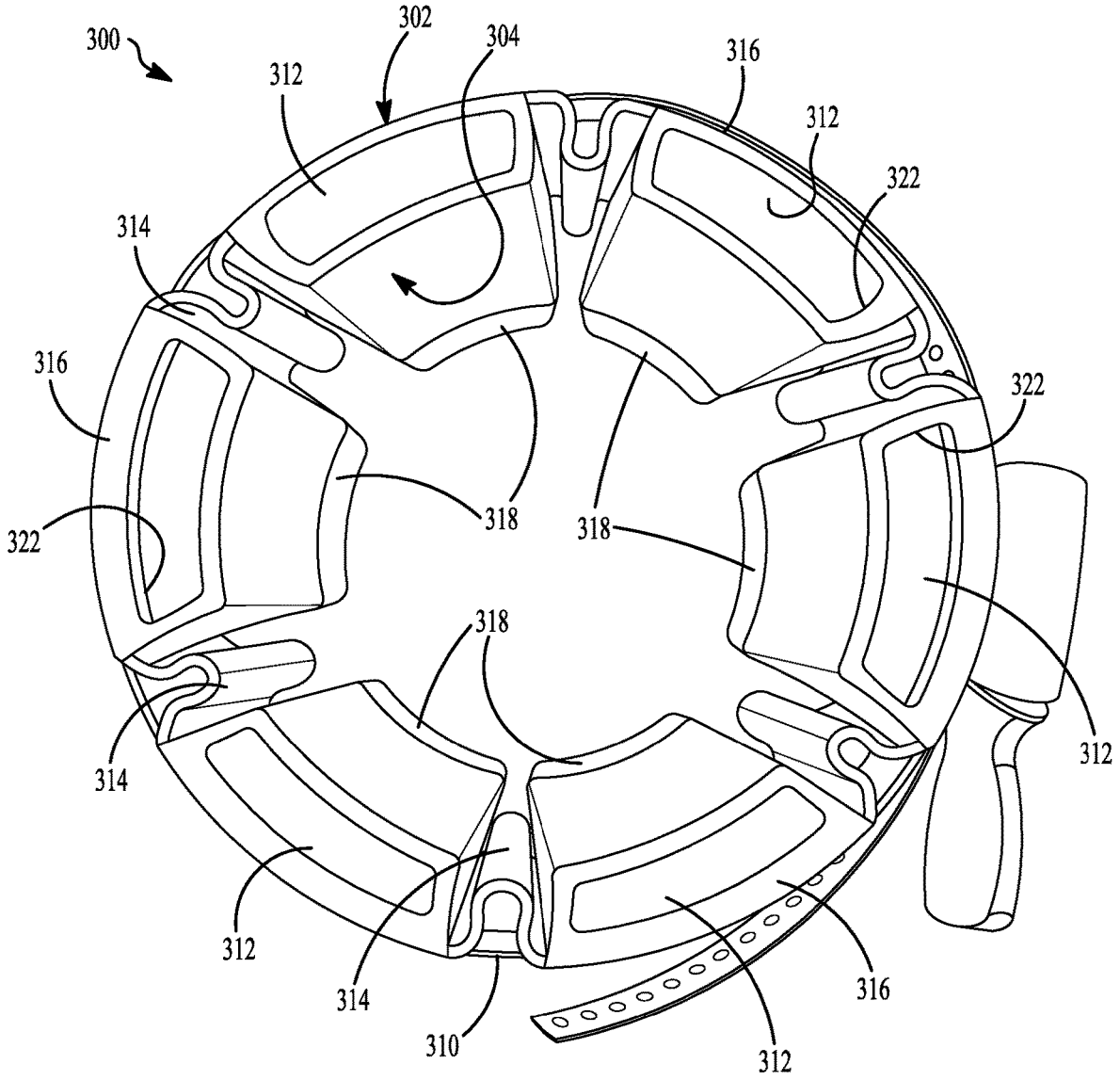
FIG. 8 illustrates a bottom view of the alternative bat swing training aid of FIG. 7.
Figure 9:
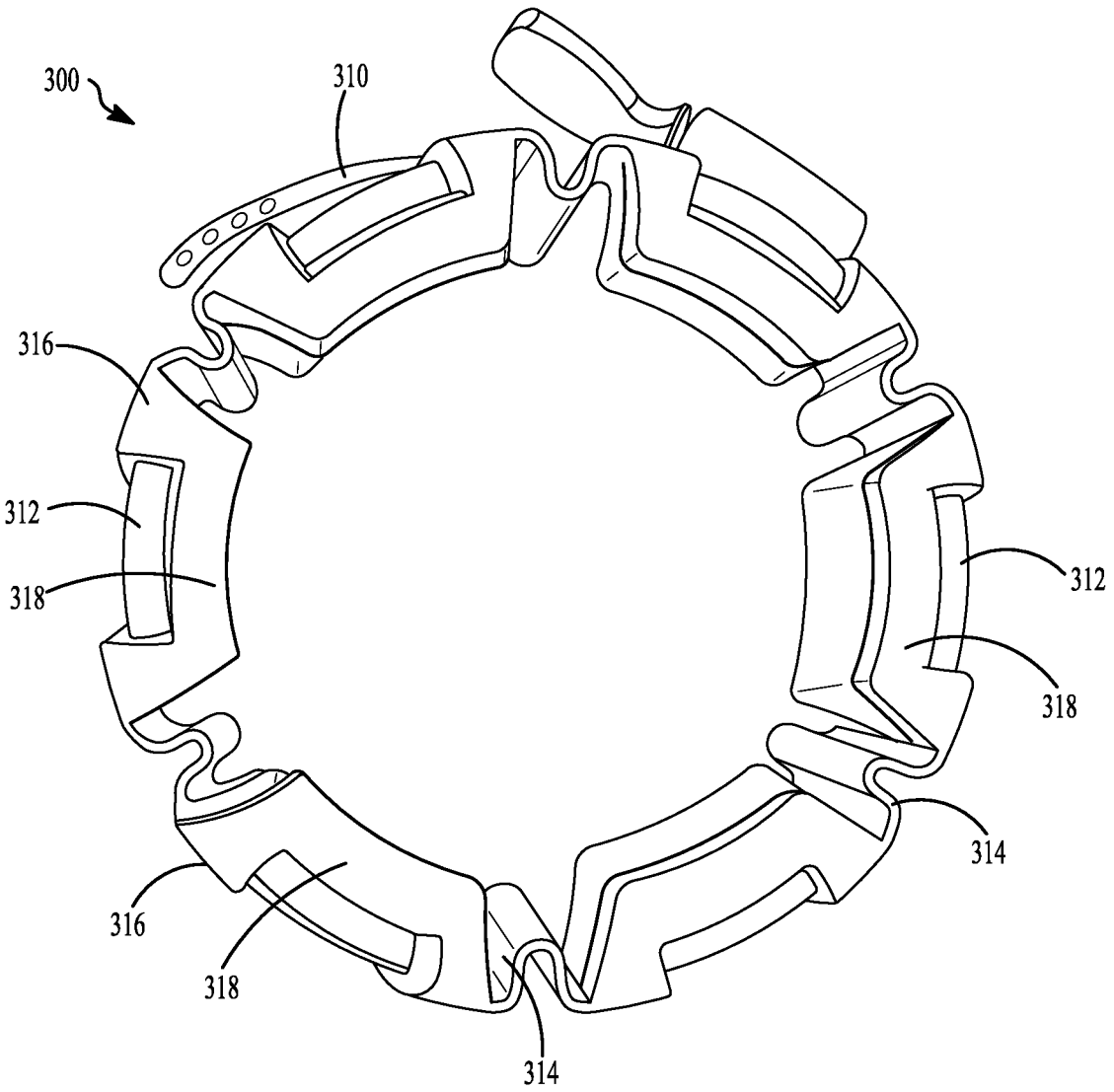
FIG. 9 illustrates a top view of the alternative bat swing training aid of FIG. 7.

FIGS. 7-9 illustrate an alternative bat swing training aid 300 according to principles of the present disclosure. The training aid 300 includes features similar to those of the training aids described above. The training aid 300 is most similar to the training aid 200, with some differences as described below.

The training aid 300, like the training aid 100 and the training aid 200, includes a selectively adjustable weight value, such that the weight value of the training aid 300 may be adjusted to accommodate changes in the batter's batting skills, size, and/or age. Further, the training aid 300 includes an inner diameter that is selectively adjustable, such that the training aid 300 can be adjusted to fit a variety of barrels corresponding to various bats, such as various baseball bats and/or softball bats. The training aid 300 is selectively attachable to and removable from a bat, such as a bat 203. The training aid 300 may comprise a polymer material, such as a rubberized polymer material that includes anti-slip characteristics. In some implementations, the polymer material may be a translucent polymer so that the weight elements 312, described below, are visible.

The training aid 300 includes a body 301 having an outer surface 302 and an inner surface 304. The training aid 300 may be formed of more than one material, such that the body 301 comprises a hardened material resisting damage, and the inner surface 304 is lined with a material that will not damage the bat. The training aid 300 includes a weight value that is a combination of its base weight value and the weight values of any weight elements 312 supported by the body 301 as described below. The training aid 300, when attached or coupled to the barrel of the bat, increases a weight value of the bat by the weight value of the training aid 300. Like the training aid 100 and particularly training aid 200, the training aid 300 is sized for attachment or coupling proximate the end of the bat, such that the batter feels the end of the bat (e.g., due to the additional weight of the training aid 300 disposed at the end of the bat) when the batter swings the bat. The training aid 300 is affixed to proximate the end of the bat so that the training aid 300 does not interfere with the bat contacting the ball (e.g., when the batter swings the bat at the ball). That is, the training aid 300 is mounted or attached in an area where a correct swing would generally avoid contacting a ball.

The body 301 of the training aid 300 has a generally cylindrical profile and is adapted to slide over the end of the barrel of a bat. The body 301, like the body 201, may include an accordion like profile that allows one or more portions of the body 301 to adjust when clamped, as will be described. The accordion like profile allows the body 301 to be adjustable to accommodate various barrel sizes corresponding to various bats, such as various baseball bats and/or softball bats. The body 301 of the training aid 300 includes a first portion 306 and a second portion 308. The first portion 306 is disposed on the body 301 opposite the second portion 308. The training aid 300 includes a clamping member 310 disposed on the body 301 between the first portion 306 and the second portion 308.

The generally cylindrical profile of the body 301 is sized to fit loosely over the end of the barrel of a bat before clamping. The accordion like profile of the body 301 is formed by the first portion 306, which in this example includes accordion type hinges 314 between hinge pockets 316. Also in this example, and as best seen in FIGS. 8 and 9, there are six hinge pockets 316, each able to hold a weight (also called a weight element) 312. The generally cylindrical body 301 is formed so that the hinge pockets 316 of the first portion 306 have respective extensions, teeth, or flanges 318 that extend radially inward (e.g., along a curve such that the inner surface—the radially-facing surface—of the flanges 318 are curved). Accordingly, when the body 301 is fitted over a bat, the extensions 318 extend towards the axis of the bat. In some implementations, the extensions 318 may loosely contact the top or end of the bat before clamping. Desirably, when the clamping member 310 is tightened as described below, the inner surface 304 is secured at least in part to the outer diameter of the bat, and the extensions 318 are secured at least in part in contact with the surface of the bat as shown in FIG. 7, in a like manner as shown in FIGS. 5 and 6.

The hinge pockets 316 of the first portion 306 may extend to the second portion 308. The second portion 308 may comprise one or more flanges against which to secure the clamping member 310. In this example, the second portion 308 comprises a plurality of flanges 220 that extend radially outward from the hinge pockets 316. The second portion 308 may comprises a flange extending about the entire circumference of the body 301, with minimal accordion type hinges corresponding to the placement of the accordion type hinges 314.

The weight value of the training aid 300 is selectively adjustable between a first weight value and one of a plurality of weight values. For example, the first weight may correspond to a base weight of the training aid 300 (i.e., without any added weights) as described above with regards to the training aids 100, 200. The first weight value may be 2 ounces, or another base weight value. Additional weight may be added to the training aid 300. For example, the training aid 300 includes a respective weight element 312 in one or more weight retainers 322. The weight retainers 322 may include pockets, sleeves, or other suitable weight retainers. The weight retainers 322 may be disposed circumferentially around the inner diameter of a portion of the inner surface 304 corresponding to the first portion 306. The weight retainers 322 are adapted to receive and/or retain one or more weight elements. For example, a weight retainer 322 may include an inner portion having a profile corresponding to an outer profile of a weight element 312, similar to the arrangement between the weight retainers 222 and the weight elements 212 shown by the dashed lines in FIG. 4.

The weight retainer 322 may include one or more retaining members for retaining a respective weight element 312. For example, the retaining members may include springs, clamps, adhesives, pockets, or other suitable retaining members. In FIGS. 7-9, the weight elements 312 are press fit into respective weight retainers 322, for example when the clamping member 310 is an unclamped position (that is, for example, loosely attached to the body 301 without securing the body 301 to the bat), or when the clamping member 310 is completely unattached from the body 301. In the training aid 300, in contrast to the training aid 200, the weight elements 312 may also be inserted or removed when the clamping member 310 is in the clamping position, that is, where the clamping member 310 is ratcheted, screwed, crimped, or otherwise moved from the unclamped position to the clamping position about the body 301 between the first portion 306 and the second portion 308, and specifically between the hinge pockets 316 and the plurality of flanges 320.

Similar to the arrangement of the training aid 200, the top edge of the weight element 312 is wider than an opening along the outer peripheral surface of a hinge pocket 316. As a result, the weight element 312 is secured during a swing. A weight element 312 may be removed by pushing along the top edge of the weight element 312 that extends to the opening along the outer peripheral surface of a hinge pocket 316, whether or not the clamping member 310 is moved to the unclamped position or removed.

In some embodiments, the weight elements are formed of steel or another suitable material. In this example, the weight or weight elements 312 are molded from a polymer with a metal filler to have smooth edges and to be contoured generally to conform to the surface of the bat, such as shown in FIGS. 8 and 9. The polymer may be a high-specific gravity polymer. The weight elements 312 may have a predetermined weight value. For example, a weight element 312 may have a weight value of 1 ounce such that the weight value of the training aid 300 may be increased over time from the first weight value to a maximum weight value, as described previously. In this example, each of the hinge pockets 316 has a respective weight element 312 within a respective weight retainer 322. Accordingly, for a 2-ounce body 301, and the weight elements 312 each having a weight value of 1 ounce, the training aid 300 has a maximum weight value of 8 ounces. The weight of the clamping member 210 is generally negligible, but the clamping member 310 may function as a weighting element in some implementations, hence adding to the weight of a training aid. The clamping member 310 may be considered in determining the base weight value.

The clamping member 310 may include an over center clamping member or other suitable clamping member. The clamping member 310 is used to secure the training aid 300 to the barrel of the bat. For example, the training aid 300 may be slide over the end of the barrel of the bat. The clamping member 210 may then be adjusted to a clamping position such that the inner surface 304 of the training aid 300 is drawn in toward the outer surface of the barrel of the bat (i.e., by reduction of its inner diameter), such that the training aid 300 fits snug around the end of the barrel of the bat. The inner surface 304, due to the presence of the accordion type hinges 314 between the hinge pockets 316, varies so that the training aid 300 can be used with bats of different diameters as previous described.

In the training aid 300, the clamping member 310 includes a molded band clamp with a toggle mechanism. The clamping member 310 may use the toggle mechanism to tighten and loosen the molded band. The toggle mechanism may move through a screwing motion. The clamping member 310 may alternatively be a ratcheting mechanism with features similar to those of the ratcheting mechanism 113 of the training aid 100. The clamping member 310 adjustable between a plurality of diameters, such as the first and second diameters discussed above with regards to the training aid 200 so that the training aid 300 may be used with bats of different diameters. Other designs for the clamping member 310 are possible. Desirably, any clamping member 310 is relatively light weight (e.g., less than an ounce), extends at least about a portion of the circumference of the body 301, and is capable of clamping the body 301 in different positions such that the inner diameter formed by the inner surface 304 is adjustable.

As used herein, the terminology "or" is intended to mean an inclusive "or" rather than an exclusive "or". That is, unless specified otherwise, or clear from context, "X includes A or B" is intended to indicate any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Further, for simplicity of explanation, although the figures and descriptions herein may include sequences or series of steps or stages, elements of the methods disclosed herein may occur in various orders or concurrently. Additionally, elements of the methods disclosed herein may occur with other elements not explicitly presented and described herein. Furthermore, not all elements of the methods described herein may be required to implement a method in accordance with this disclosure. Although aspects, features, and elements are described herein in particular combinations, each aspect, feature, or element may be used independently or in various combinations with or without other aspects, features, and elements.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bat swing training aid, comprising:

a body having a generally cylindrical profile that includes a first portion and a second portion, the body being selectively attachable to a barrel of a bat and having a selectively adjustable weight value;

a clamping member disposed between the first portion and the second portion, the clamping member having an undamped position and having a clamping position where the body is in contact with the barrel of the bat;

an inner surface defining an inner diameter that is selectively adjustable in response to the clamping member being in the clamping position;

a hinge between the first portion and the second portion, and wherein at least one of the first portion or the second portion is rotatable about the hinge to engage the inner surface with the barrel; and one or more weight retainers disposed around a portion of the inner surface corresponding to the first portion, each of the one or more weight retainers arranged to receive a weight element having a defined weight value.

2. The bat swing training aid of claim 1, wherein the body comprises a polymer material.

3. The bat swing training aid of claim 2, wherein the polymer material comprises a rubberized polymer material that includes anti-slip characteristics.

4. The bat swing training aid of claim 1, wherein a polymer material of the body is translucent.

5. The bat swing training aid of claim 1, wherein the second portion is rotatable about the hinge between a first position and a second position, the first position corresponding to a first inner diameter of the inner surface, and the second position corresponding to a second inner diameter of the inner surface.

6. The bat swing training aid of claim 1, wherein the clamping member comprises an over center clamping member arranged at an outer surface of the body, and further comprising:

a ratcheting mechanism about a portion of the body, wherein the ratcheting mechanism is arranged to selectively adjust the inner diameter while the clamping member is in the clamping position.

7. The bat swing training aid of claim 1, wherein each weight retainer comprises at least one of a pocket or a sleeve.

8. The bat swing training aid of claim 7, further comprising:

the weight element arranged in one of the pocket or the sleeve of a weight retainer, the weight element resulting in a weight value for the bat swing training aid of up to a maximum weight value.

9. The bat swing training aid of claim 1, wherein the first portion is generally cylindrical, and the one or more weight retainers comprise a plurality of weight retainers arranged circumferentially about the first portion.

10. The bat swing training aid of claim 9, wherein the weight element is sized for press fitting within a weight retainer of the plurality of weight retainers.

11. A bat swing training aid, comprising:

a body having a generally cylindrical profile that includes a first portion and a second portion, the body being selectively attachable to a barrel of a bat and having a selectively adjustable weight value;

a clamping member disposed between the first portion and the second portion, the clamping member having an undamped position and having a clamping position where the body is in contact with the barrel of the bat;

an inner surface defining an inner diameter that is selectively adjustable in response to the clamping member being in the clamping position; and one or more weight retainers disposed around a portion of the inner surface corresponding to the first portion, each of the one or more weight retainers arranged to receive a weight element having a defined weight value, wherein:

the first portion comprises a plurality of hinge pockets spaced by accordion type hinges arranged into the generally cylindrical profile, each of the hinge pockets forming a respective weight retainer, and the second portion comprises at least one flange extending radially outward from a first edge of the first portion.

12. The bat swing training aid of claim 11, wherein:

the first portion comprises at least one flange extending radially inward from a second edge of the first portion opposite from the first edge.

13. The bat swing training aid of claim 12, wherein:

the at least one flange of the first portion comprises a plurality of flanges, each respectively extending from a hinge pocket of the plurality of hinge pockets, and each of the plurality of flanges of the first portion having a curved radially-facing surface.

14. The bat swing training aid of claim 11, wherein:

the at least one flange of the second portion comprises a plurality of flanges, each extending radially outward from the first edge of a respective hinge pocket of the plurality of hinge pockets.

15. The bat swing training aid of claim 11, wherein the second portion comprises a plurality of hinged clamp flanges with an outermost radially extending flange edge, the plurality of hinged clamp flanges having an open position that provides access to a respective weight retainer to receive a respective weight element, and having a closed position that allows the clamping member to secure the plurality of hinged clamp flanges to the bat.

16. The bat swing training aid of claim 11, wherein the body comprises a rubberized polymer material that includes anti-slip characteristics.

17. The bat swing training aid of claim 11, wherein the body comprises a translucent polymer material.

18. The bat swing training aid of claim 11, wherein the clamping member comprises an over center clamping member arranged at an outer surface of the body, and further comprising:

a ratcheting mechanism about a portion of the body, wherein the ratcheting mechanism is arranged to selectively adjust the inner diameter while the clamping member is in the clamping position.

19. The bat swing training aid of claim 11, further comprising:

a weight element supported within a weight retainer.

20. The bat swing training aid of claim 19, wherein the weight element is sized for press fitting within the weight retainer.

* * * * *